US007090598B2

(12) United States Patent
Elliot et al.

(10) Patent No.: US 7,090,598 B2
(45) Date of Patent: Aug. 15, 2006

(54) BASKETBALL TRAINING DEVICE

(75) Inventors: Kim Elliot, 225 Lake Blaine Rd., Kalispell, Libby, MT (US) 59901; Doug Hashley, Kalispell, Libby, MT (US)

(73) Assignee: Kim Elliot, Kalispell, MT (US)

( * ) Notice: Subject to any disclaimer, the term of this patent is extended or adjusted under 35 U.S.C. 154(b) by 0 days.

(21) Appl. No.: 10/165,574

(22) Filed: Jun. 8, 2002

(65) Prior Publication Data

US 2004/0242350 A1 Dec. 2, 2004

(51) Int. Cl.
*A63B 69/00* (2006.01)

(52) U.S. Cl. ..... 473/448; 473/447; D21/701

(58) Field of Classification Search ..... 473/481, 473/447, 438, 448, 485, 433; 211/90.03
See application file for complete search history.

(56) References Cited

U.S. PATENT DOCUMENTS 4,300,764 A * 11/1981 Burke ..... 473/485
4,739,988 A * 4/1988 Schroeder ..... 473/481
5,279,496 A * 1/1994 Schroeder ..... 473/483
5,813,930 A * 9/1998 Strauther ..... 473/485
6,312,349 B1 * 11/2001 Roberts ..... 473/448
6,543,630 B1 * 4/2003 Hope ..... 211/133.5

* cited by examiner

*Primary Examiner*—Eugene Kim
*Assistant Examiner*—M. Chambers

(57) ABSTRACT

A basketball training apparatus for use with a basketball goal is secured to a backboard, the apparatus including a blocking element secured to the backboard. In an embodiment, the blocking element is a generally planar ledge secured to the backboard at a height substantially equal to the height of a top surface of the basketball goal. The generally planar ledge can be constructed to include a center portion extending outwardly from a center of the backboard. A right side portion can extend outwardly from the backboard along a right side of the backboard from the center portion to a right edge of the backboard, and a left side portion can extend outwardly from the backboard along a left side of the backboard from the center portion to a left edge of the backboard.

10 Claims, 2 Drawing Sheets

BASKETBALL TRAINING DEVICE

FIELD OF THE INVENTION

The present invention relates generally to basketball training devices. Specifically, the present invention relates to devices for improving accuracy and consistency in close-range basketball shots.

BACKGROUND OF THE INVENTION

As chronicled by historian Mary Bellis on About.com, the Canadian physician and educator James Naismith invented basketball in December 1891. Prompted by the request of his superior to produce an alternative for students bored with the traditional winter physical education routines of calisthenics and gymnastic in Springfield, Mass., Naismith affixed two peach baskets to a 10-foot-high railing. Students scored points by tossing a soccer ball into the basket, governed by a set of rules eventually published by Naismith in 1892.

Although no contemporary record of the details of the first basketball game exists, it is likely that at least one of the players in that nascent contest had a can't-miss, point-blank shot bounce off of the backboard, roll off the rim of the peach basket, and fall harmlessly away. It is perhaps fortunate for those players that history has forgotten the name of the first player to blow a lay-up. It has certainly become apparent in the intervening century of basketball that there is a need for increased shooting accuracy from all ranges, including close range.

In an attempt to satisfy this need, a variety of basketball shooting training devices have been devised. Many of these devices are represented in the patent literature. For example, U.S. Pat. No. 6,190,270 Barry is directed to an athletic shooting aid adapted to be detachably mounted directly on the goal of a sporting event to provide a target at which the player aims and strikes with the game piece in order to improve the form and accuracy of the player's shooting. The device comprises a clamp which is removably attachable to the goal having a substantially straight elongated member extending from the clamp with a ball or target of material attached to the elongated member to serve as the target at which the player aims when shooting the game piece. The elongated member is adapted and configured to allow the ball to move when struck by the game piece in such a manner that the game piece deflects the ball without substantially affecting the trajectory of the game piece and to allow the ball to be repositioned after the game piece has passed through the goal.

In another example, U.S. Pat. No. 4,226,416 to Callahan deals with a basketball practice assembly that may be removably secured to a back board supported hoop in a desired position to assist a player in improving his ability to make successful free throws or side shots. The practice assembly is of such design that two of them may be oppositely positioned on side portions of a basketball hoop to permit two players to simultaneously practice side shots.

Similarly, U.S. Pat. No. 4,206,915 Woodcock discusses a basketball practice device adapted to be detachably mounted on a standard basketball goal to improve the form of the players in shooting goals. The device comprises a base which can be clamped to a standard basketball goal. This base has a plurality of radially outwardly extending members joined thereto. The outermost ends of the radially extending members have free-standing vertical elements so that they extend upwardly from the goal to deflect basketball shots having an undesirable trajectory.

Despite these and other training devices, basketball players at every level are still missing an unnecessarily high number of shots. The fact that many of these shots are easy lay-ups is distressing, not only to the players themselves, but to coaches and fans as well. It can thus be seen that the need exists for a simple, inexpensive, training device that will effectively increase the shooting skill of basketball players.

SUMMARY OF THE INVENTION

These and other objects are achieved by providing a basketball training apparatus for use with a basketball goal secured to a backboard, the apparatus including a generally planar ledge secured to the backboard.

In an embodiment, the generally planar ledge is secured to the backboard at a height substantially equal to the height of a top surface of the basketball goal. The generally planar ledge can be constructed to include a center portion extending outwardly from a center of the backboard. A right side portion can extend outwardly from the backboard along a right side of the backboard from the center portion to a right edge of the backboard, and a left side portion can extend outwardly from the backboard along a left side of the backboard from the center portion to a left edge of the backboard.

The features of the invention believed to be patentable are set forth with particularity in the appended claims. The invention itself, however, both as to organization and method of operation, together with further objects and advantages thereof, may best be understood by reference to the following description taken in conjunction with the accompanying drawings.

DETAILED DESCRIPTION OF THE INVENTION

Figure 1:
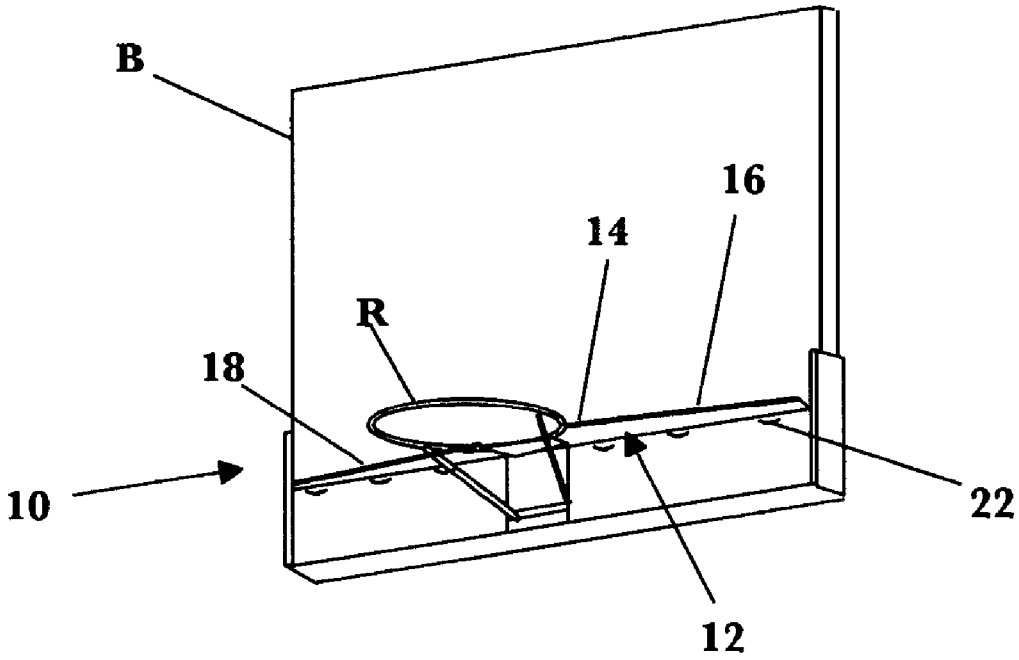
FIG. 1 is a schematic perspective view of a training apparatus constructed in accordance with the principles discussed herein.
Figure 2:
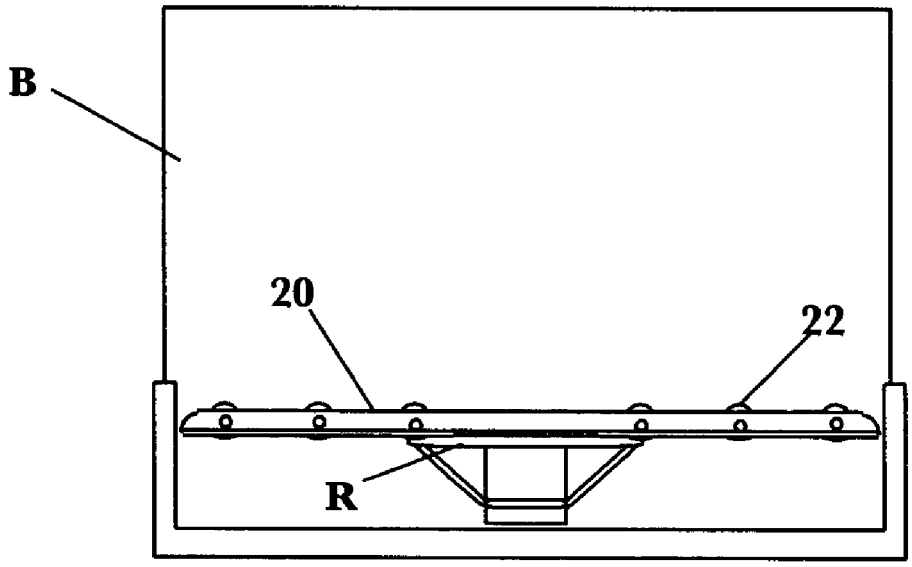
FIG. 2 is a front elevational view of the container illustrated in FIG. 1.
Figure 3:
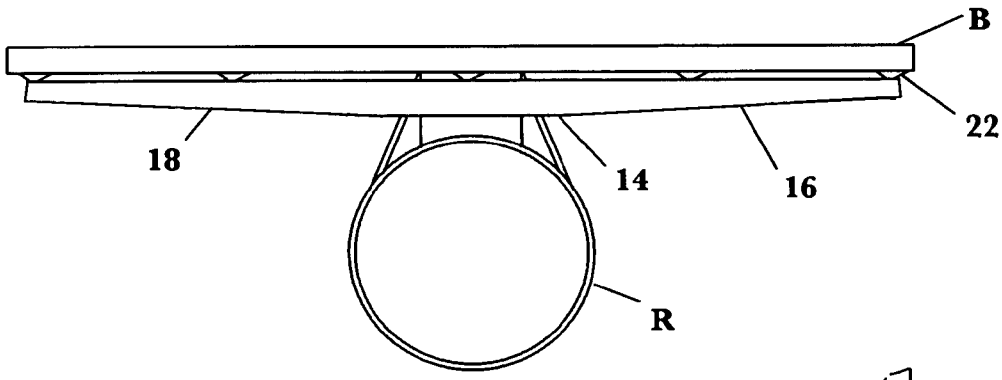
FIG. 3 is a plan view of the apparatus illustrated in FIG. 1.
Figure 4:
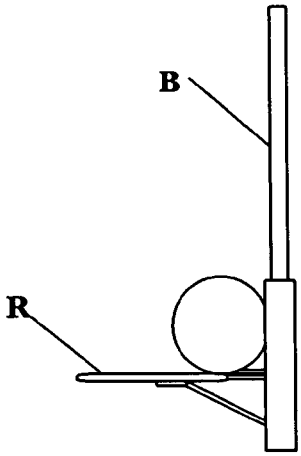
FIG. 4 is a side view of the apparatus illustrated in FIG. 1.
Figure 5:
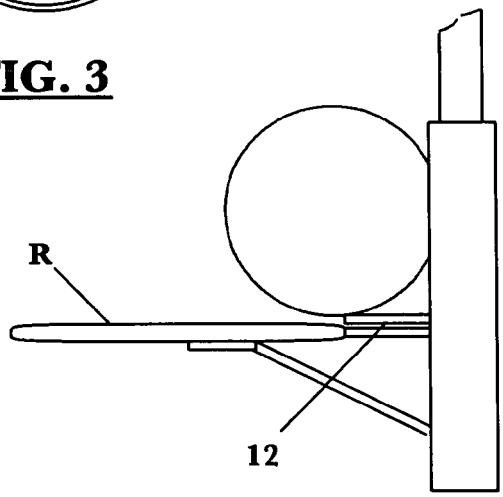
FIG. 5 is detail of the side view shown in FIG. 4.

While this invention is susceptible of embodiment in many different forms, there is shown in the drawings, and will herein be described in detail, exemplary embodiments, with the understanding that the present disclosure is to be considered as illustrative of the principles of the invention and not intended to limit the invention to the exemplary embodiments shown and described.

A training apparatus 10 in accordance with the principles of the present invention is shown in FIG. 1. The apparatus 10 is for use with a backboard B and basketball goal G with a rim R of standard construction. The apparatus 10 in the embodiment shown in FIGS. 1–5 includes a blocking element constructed as generally planar ledge 12 extending outwardly from the backboard B. The generally planar ledge 12 includes a center portion 14 extending outwardly from a center of the backboard B, with a right side portion 16 extending outwardly from the backboard B along a right side of the backboard B from the center portion 14 to a right edge of the backboard B. A left side portion 18 extends outwardly from the backboard B along a left side of the backboard B from the center portion 14 to a left edge of the backboard B.

The apparatus 10 is secured to the backboard B at a height substantially equal to the height of a top surface of the basketball goal G. In the embodiment shown in FIGS. 1–5, the apparatus 10 includes a securing plate 20 extending at a 90 degree angle from the generally planar ledge 12. A plurality of securing members 22 are provided to attach the generally planar ledge 12 to the backboard B. The securing members 22 are advantageously provided as temporary securing members, such as suction cups or the like, to selectively secure the apparatus 10 to the backboard B.

The apparatus 10 can be fabricated from a suitable rigid material, such as 0.188" PETG. Although the ledge can be constructed within a range of dimensions, it has been found that an embodiment wherein the center portion 14 has a depth of approximately between 3 inches to 4 inches, particularly of approximately 3.56 inches, provides particular advantages. In such an embodiment, the left and right side portions (16, 18) taper from approximately 3.56 inches adjacent to the center portion 14 to approximately 2.75 inches at the respective edges of the backboard B, which has a width of approximately 70 inches.

Figure 6:
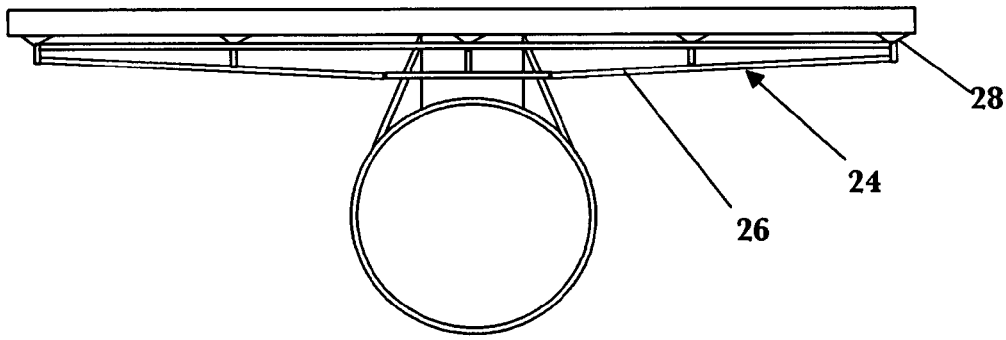
FIG. 6 is a schematic plan view of an alternative embodiment of a training apparatus constructed in accordance with the principles discussed herein.

An alternative embodiment of a training apparatus 24 constructed in accordance with the principles of the present invention is shown in FIG. 6. The apparatus 24 is shown as a blocking element provided as a rod 26 dimensionally similar to the planar ledge of the previous embodiment, fabricated from a suitable material, for example, graphite or kevlar composite material or metal such as stainless steel. The rod 26 is secured to the backboard B' with a plurality of securing members 28, advantageously provided as temporary securing members, such as suction cups or the like.

In operation, a player shoots lay-ups toward the goal with the apparatus in place. With a proper shot, the basketball clears the blocking element, bounces off of the backboard, and into the basketball goal. If the ball is shot improperly, the basketball is deflected by the generally planar ledge and returns to the player. With repetition, the player develops muscle memory to shoot the ball so as to avoid the blocking element. Consequently, the player retains this muscle memory when the locking element is subsequently removed, as in game situations.

Although the present invention has been described with reference to specific embodiments, those of skill in the art will recognize that changes may be made thereto without departing from the scope and spirit of the invention as defined by the appended claims.

What is claimed is:

1. A basketball training apparatus for use with a basketball goal secured to a backboard, the apparatus comprising the following:

a blocking element extending substantially along the entire width of the backboard from the backboard towards the basketball goal, the blocking element being configured whereby, with a proper layup, the basketball clears the blocking element, bounces off of the backboard, and into the basketball goal and, with an improper layup shot too close to the backboard, the basketball is deflected by the blocking element; and a securing mechanism adapted and constructed to secure the blocking element to the backboard;

wherein the blocking element comprises a generally planar ledge; wherein the generally planar ledge is secured to the backboard at a height substantially equal to the height of a top surface of the basketball goal; wherein the generally planar ledge further comprises the following: a center portion extending outwardly from a center of the backboard; a right side portion extending outwardly from the backboard along a right side of the backboard from the center portion to a right edge of the backboard; and a left side portion extending outwardly from the backboard along a left side of the backboard from the center portion to a left edge of the backboard wherein the left and right side portions taper from the center portion to the respective edges of the backboard.

2. An apparatus according to claim 1, wherein the center portion has a depth of approximately between 3 inches to 4 inches.

3. An apparatus according to claim 2, wherein the center portion has a depth of approximately 3.56 inches.

4. An apparatus according to claim 3, wherein the left and right side portions taper from approximately 3.56 inches adjacent to the center portion to approximately 2.75 inches at the respective edges of the backboard.

5. A basketball training apparatus for use with a basketball goal secured to a backboard, the apparatus comprising the following:

a blocking element extending substantially along the entire width of the backboard from the backboard towards the basketball goal, the blocking element being configured whereby, with a proper layup, the basketball clears the blocking element, bounces off of the backboard, and into the basketball goal and, with an improper layup shot too close to the backboard, the basketball is deflected by the blocking element; and a securing mechanism adapted and constructed to secure the blocking element to the backboard, wherein the blocking element comprises a generally planar ledge, wherein the generally planar ledge is fabricated from a rigid plastic material and further comprising a securing plate extending from the generally planar ledge.

6. An apparatus according to claim 1, wherein the blocking element comprises a rod.

7. An apparatus according to claim 5, wherein the securing plate extends at approximately a 90° angle from the generally planar ledge.

8. An apparatus according to claim 7, further comprising a plurality of securing members attached between the securing plate and the backboard.

9. An apparatus according to claim 8, wherein the plurality of securing members comprise a plurality of temporary securing members.

10. An apparatus according to claim 9, wherein each of the plurality of temporary securing members comprises the following:

a fastener fixedly secured to the securing plate; and a flexible suction member adapted and constructed to be selectively secured to a front surface of the backboard.

* * * * *